US009409424B2

(12) United States Patent
Vandermeulen

(10) Patent No.: US 9,409,424 B2
(45) Date of Patent: Aug. 9, 2016

(54) PRINTING APPARATUS

(71) Applicant: DYMO, Sint-Niklaas (BE)

(72) Inventor: Kris Vandermeulen, Bornem (BE)

(73) Assignee: DYMO, Sint-Niklaas (BE)

( * ) Notice: Subject to any disclaimer, the term of this patent is extended or adjusted under 35 U.S.C. 154(b) by 0 days.

(21) Appl. No.: 14/435,764

(22) PCT Filed: Oct. 3, 2013

(86) PCT No.: PCT/EP2013/070653

§ 371 (c)(1),
(2) Date: Apr. 15, 2015

(87) PCT Pub. No.: WO2014/060220

PCT Pub. Date: Apr. 24, 2014

(65) Prior Publication Data

US 2015/0283831 A1 Oct. 8, 2015

(30) Foreign Application Priority Data

Oct. 15, 2012 (GB) ..... 1218458.6

(51) Int. Cl.

| | |
|---|---|
| ***B41J 2/01*** | (2006.01) |
| ***B41J 11/70*** | (2006.01) |
| ***B26D 5/14*** | (2006.01) |
| ***B26D 1/08*** | (2006.01) |

(Continued)

(52) U.S. Cl.

CPC ..... *B41J 11/70* (2013.01); *B26D 1/085* (2013.01); *B26D 5/14* (2013.01); *B26D 7/2614* (2013.01); *B41J 11/703* (2013.01); *B41J 11/001* (2013.01); *B41J 11/66* (2013.01); *B41J 11/663* (2013.01)

(58) Field of Classification Search

None

See application file for complete search history.

(56) References Cited

U.S. PATENT DOCUMENTS

| | | | |
|---|---|---|---|
| 5,174,670 | A | 12/1992 | Takagi et al. |
| 5,974,930 | A | 11/1999 | Longrod |

(Continued)

FOREIGN PATENT DOCUMENTS

| | | |
|---|---|---|
| JP | 3-278975 | 12/1991 |

OTHER PUBLICATIONS

Search Report and Written Opinion in International Application No. PCT/EP2013/070653 dated Jan. 15, 2014.

(Continued)

*Primary Examiner* — Lisa M Solomon

(74) *Attorney, Agent, or Firm* — Marshall, Gerstein & Borun LLP

(57) ABSTRACT

A printing device comprising: a housing; a printing mechanism; a receiving portion for receiving a supply of image receiving medium; a cutting mechanism for cutting the image receiving medium; a drive mechanism for driving the cutting mechanism during a cutting operation; wherein the cutting mechanism comprises a blade holder removably attachable in the printing device; and said drive mechanism comprises at least one of a drive member or engaging portion for engaging with a respective other of at least one drive member or engaging portion of said blade holder; wherein said drive member is configured to be received in said engaging portion when said blade holder is in the printing device, and wherein said drive member and engaging portion are configured to permit said blade holder to be inserted in said printing device when said blade holder is moved in a direction of insertion, and to permit said blade holder to be removed from said printing device when said blade holder is moved in a direction of removal.

15 Claims, 9 Drawing Sheets

(51) Int. Cl.

| | |
|---|---|
| ***B26D 7/26*** | (2006.01) |
| *B41J 11/00* | (2006.01) |
| *B41J 11/66* | (2006.01) |

(56) References Cited

U.S. PATENT DOCUMENTS

| | | | | |
|---|---|---|---|---|
| 6,279,446 | B1 | 8/2001 | Halket et al. | |
| 2003/0198499 | A1 | 10/2003 | Tsuchiya et al. | |
| 2006/0269346 | A1 | 11/2006 | Takayama | |
| 2008/0069623 | A1 | 3/2008 | Kobayashi et al. | |
| 2008/0310902 | A1 | 12/2008 | Kubota et al. | |
| 2012/0024121 | A1 * | 2/2012 | Balahan | B26D 1/065 83/13 |

OTHER PUBLICATIONS

Search Report in GB Application No. 1218458.6 dated Apr. 9, 2014, 3 pages.

* cited by examiner 404
406
408
410
412
414
390
392
394
396
SCALE 3.000

PRINTING APPARATUS

The present invention relates to a printing apparatus. More particularly the present invention relates to a printing apparatus comprising a cutter.

Known label printing apparatuses are disclosed in EP-A-322918 and EP-A-322919 (Brother Kogyo Kabushiki Kaisha) and EP-A-267890 (Varitronic). The label printing apparatuses each include a cassette receiving bay for receiving a cassette or tape holding case. In EP-A-267890, the tape holding case houses an ink ribbon and a substrate tape, the latter comprising an upper image receiving layer secured to a backing layer by an adhesive. In EP-A-322918 and EP-A-322919, the tape holding case houses an ink ribbon, a transparent image receiving tape and a double sided adhesive tape which is secured at one of its adhesive coated sides to the image tape after printing and which has a backing layer peelable from its other adhesive coated side. With both these apparatus, the image transfer medium (ink ribbon) and the image receiving tape (substrate) are in the same cassette.

It has also been proposed by the present applicants in, for example, EP-A-578372 to house the ink ribbon and the substrate tape in separate cassettes.

In all of these cases, the image receiving tape passes in overlap with the ink ribbon to a print zone consisting of a fixed print head and a platen against which the print head can be pressed to cause an image to transfer from the ink ribbon to the image receiving tape. There are many ways of doing this, including dry lettering or dry film impression, but the most usual way currently is by thermal printing where the print head is heated and the heat causes ink from the ink ribbon to be transferred to the image receiving tape.

In other known tape printing apparatuses, so-called direct thermal tapes are used, in which an image is created directly onto the direct thermal tape without the interposition of an ink ribbon cassette. Elements of a print head are heated, and the heat causes chemicals within the direct thermal tape to react and produce an image in or on the tape.

The apparatuses of the type described above are provided with a keyboard which enables a user to enter characters, symbols and the like to form an image to be printed by the tape printer. The keyboard usually has text character keys and number keys for entering letters and numbers respectively, plus some function keys which, among other things, operate menus and allow printing attributes to be set. Some apparatuses of the type described may also comprise a cutting mechanism for cutting the tape after a printing operation.

"Stand-alone" label printers can be distinguished from "label printer systems", which comprise a printer connected to a PC or other computing device. In such label printer systems, a user creates or edits a label for printing using a PC, and then sends print data to a printer to cause the printer to print the print data onto a label medium. In such label printer systems, the user will view a display of the PC to create a label, rather than a display of the printer. Also, the label-editing software used for creating the label will be stored and run on the PC, rather than the printer.

In contrast, stand-alone label printers are operable independently of a PC or other computer to create and print a label. Although some stand-alone printers are connectable to a PC or other computer to receive some data, they are nevertheless operable independently of the PC or other computer to create a label for printing, since label-editing software used for creating the label is stored and run on the label printer itself. Stand-alone label printers thus usually include an integral display via which the user can view an interface of the label-editing software.

In a first aspect there is provided a printing device comprising: a housing; a printing mechanism; a receiving portion for receiving a supply of image receiving medium; a cutting mechanism for cutting the image receiving medium; a drive mechanism for driving the cutting mechanism during a cutting operation; wherein the cutting mechanism comprises a blade holder removably attachable in the printing device; and said drive mechanism comprises at least one of a drive member or engaging portion for engaging with a respective other of at least one drive member or engaging portion of said blade holder; wherein said drive member is configured to be received in said engaging portion when said blade holder is in the printing device; and wherein said drive member and engaging portion are configured to permit said blade holder to be inserted in said printing device when said blade holder is moved in a direction of insertion, and to permit said blade holder to be removed from said printing device when said blade holder is moved in a direction of removal.

Preferably one of said engaging portion and drive member comprises a channel.

Preferably said channel extends in a direction parallel to a direction in which the blade holder is configured to be inserted in said printing device.

Preferably said blade holder comprises a holder, a fixed blade and a movable blade.

Preferably the drive member is configured to project into said engaging portion in a direction perpendicular to a direction in which the movable blade is configured to be driven.

Preferably said movable blade comprises one of said drive member and said engaging portion.

Preferably said one of said drive member and said engaging portion is located on a face of said movable blade.

Preferably said engaging portion comprises a profiled surface for locating said drive member in said engaging portion.

Preferably said drive mechanism comprises a gear train.

Preferably one of said drive member and said engaging portion is located on a gear of said gear train.

Preferably a second drive member or engaging portion is located on a second gear of said gear train.

Preferably said blade holder comprises a projection for facilitating removal of said blade holder from said printing device.

Preferably said projection is positioned on said blade holder such that said projection projects outwardly from said receiving portion of said printing device when said blade holder is attached in said printing device.

Preferably said projection is positioned substantially above said engaging portion.

Preferably said blade holder is a snap-fit in said printing device.

Preferably said snap-fit is provided by a snap-fitting mechanism provided proximate to said projection of said blade holder.

Preferably said module comprises a locking mechanism for locking the movable blade.

Preferably said printing device comprises a detector for detecting the presence of the blade holder in the printing device.

Preferably said drive mechanism comprises said at least one drive member and said blade holder comprises said at least one engaging portion.

In a second aspect there is provided a blade holder for a printing apparatus comprising: a casing; at least one of a fixed blade and a movable blade; at least one of an engaging portion or a drive member for engaging with a respective other of at least one of an engaging portion or drive member of a printing device; wherein said engaging portion is configured to receive said drive member when said blade holder is in the printing device; and said at least one of an engaging portion or drive member of the blade holder is configured to permit said blade holder to be inserted in said printing device when said blade holder is moved in a direction of insertion, and to permit said blade holder to be removed from said printing device when said blade holder is moved in a direction of removal.

Preferably one of said engaging portion and drive member comprises a channel.

Preferably said channel extends in a direction parallel to a direction in which the blade holder is configured to be inserted in said printing device.

Preferably said blade holder comprises a holder, a fixed blade and a movable blade.

Preferably said channel extends in a direction parallel to a knife surface of the fixed blade.

Preferably the drive member is configured to project into said engaging portion in a direction perpendicular to a direction in which the movable blade is configured to be driven.

Preferably said movable blade comprises one of said drive member and said engaging portion.

Preferably said one of said drive member and said engaging portion is located on a face of said movable blade.

Preferably said engaging portion comprises a profiled surface for locating said drive member in said engaging portion.

Preferably said blade holder comprises a projection for facilitating removal of said blade holder from said printing device.

Preferably said projection is positioned on said blade holder such that said projection projects outwardly from a receiving portion of said printing device when said blade holder is attached in said printing device.

Preferably said projection is positioned substantially above said engaging portion.

Preferably said blade holder is configured to be a snap-fit in said printing device.

Preferably said snap-fit is provided by a snap-fitting mechanism provided proximate to said projection of said blade holder.

Preferably said blade holder comprises a locking mechanism for locking the movable blade.

In a third aspect there is provided a printing device comprising: a housing; printing means; receiving means for receiving a supply of image receiving medium; cutting means for cutting the image receiving medium; drive means for driving the cutting means during a cutting operation; wherein the cutting means comprises a blade holder removably attachable in the printing device; and said drive means comprises at least one of a drive member or engaging means for engaging with a respective other of at least one drive member or engaging means of said blade holder; wherein said drive member is configured to be received in said engaging means when said blade holder is in the printing device, and wherein said drive member and engaging portion are configured to permit said blade holder to be inserted in said printing device when said blade holder is moved in a direction of insertion, and to permit said blade holder to be removed from said printing device when said blade holder is moved in a direction of removal.

In a fourth aspect there is provided a blade holder for a printing device comprising: a casing; at least one of a fixed blade and a movable blade; at least one of an engaging means or a drive member for engaging with a respective other of at least one of an engaging means or drive member of the printing device when received therein; wherein said engaging portion is configured to receive said drive member when said blade holder is in the printing device; and said at least one of an engaging means or drive member of the blade holder is configured to permit said blade holder to be inserted in said printing device when said blade holder is moved in a direction of insertion, and to permit said blade holder to be removed from said printing device when said blade holder is moved in a direction of removal.

Some embodiments will now be described by way of example only with reference to the accompanying Figures in which.

Figure 1:
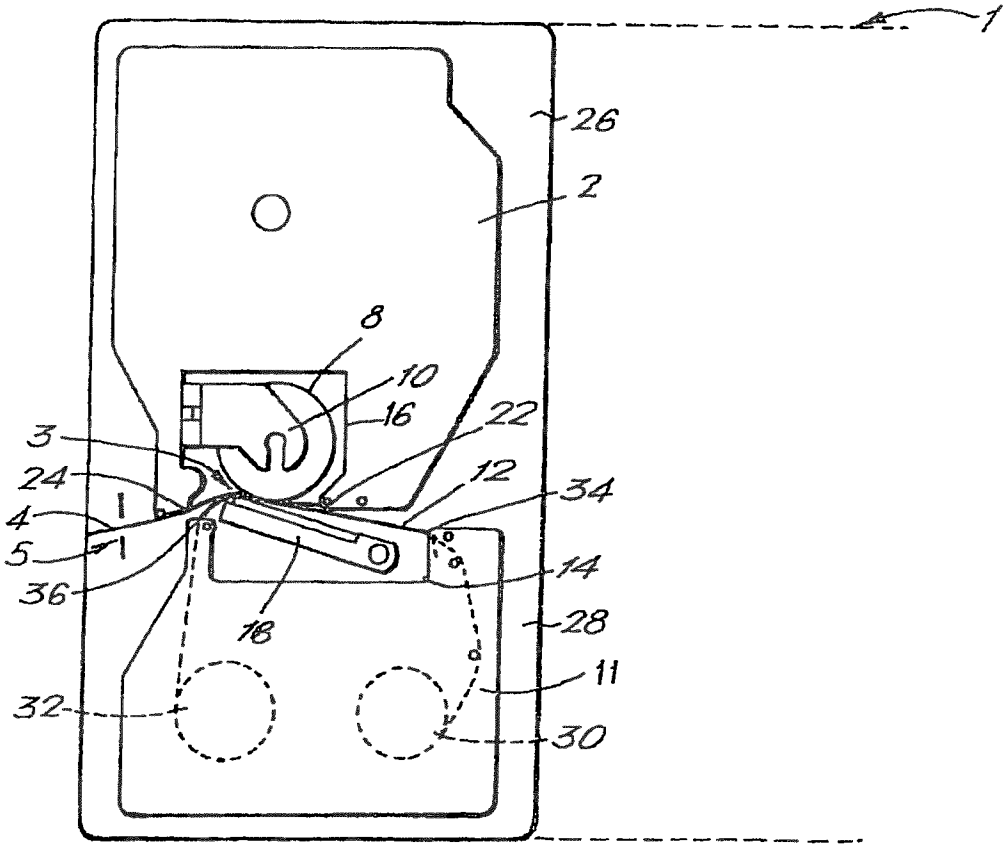
FIG. 1 shows certain parts of one type of label printer.

FIG. 1 shows in plan view certain parts of a first label printer which has two cassettes arranged therein. Typically, this label printer 1 is powered by batteries at least part of the time. Alternatively the label printer may be mains powered.

The first cassette 2 is located in a first cassette receiving portion 26 and contains a supply of image receiving tape 4 which passes through a print zone 3 of the label printer 1 to an outlet 5 of the label printer 1. The image receiving tape 4 comprises an upper layer for receiving a printed image on its upper surface and has its other surface coated with an adhesive layer to which is secured a releasable backing layer. The first cassette 2 has a recess for accommodating a platen 8 of the label printer 1, and guide portions 22 and 24 for guiding the tape through a print zone 3. The platen 8 is mounted for rotation within a case moulding 10. Alternatively the platen could be mounted for rotation on a pin.

The second cassette 11 is located in the second cassette receiving portion 28 and contains a thermal transfer ribbon 12 which extends from the supply spool 30 to a take-up spool 32 within the cassette 11. The thermal transfer ribbon 12 extends through the print zone 3 in overlap with the image receiving tape 4. The cassette 11 has recess 14 for receiving a print head 18 of the label printer 1 and guide portions 34 and 36 for guiding the thermal transfer ribbon 12 through the print zone 3. Print head 18 is moveable between an operative position shown in FIG. 1, in which it is in contact with the platen 8 and holds the thermal transfer ribbon 12 and the image receiving tape 4 in overlap between a print head 18 and the platen 8 in an inoperative position in which it is moved away from the platen 8 to release thermal transfer ribbon 12 and image receiving tape 4. In the operative position, the platen 8 is rotated to cause the image receiving tape 12 to be driven past print head 18 and the print head 18 is controlled to print an image on the image receiving tape 4 by thermal transfer of ink from the ribbon 12. Each of the printing elements on the print head 18 is activatable separately and is activated in accordance with the desired image to be printed.

A DC motor drives the platen 8. The platen is arranged to drive the image receiving tape 4 through the print zone 3 by the actuation of its own rotation. In other embodiments, transport of the image receiving tape across the print head can be done by other means, such as by a separate driven roller of the printer or of the cassette, or by a pair of cooperating rollers positioned on opposite sides of the tape, or by other means.

The image is printed by the print head 18 on the image receiving tape on a column by column basis with the columns being adjacent one another in the direction of movement of the tape 4.

In an alternative embodiment (not shown) the label printer 1 may comprise a one-cassette system. In such a system the cassette comprises a supply of thermally activatable image receiving medium which reacts when heated by the thermal printhead to provide a printed image. In such a system there is therefore no need for a separate ink-ribbon cassette.

Figure 2:
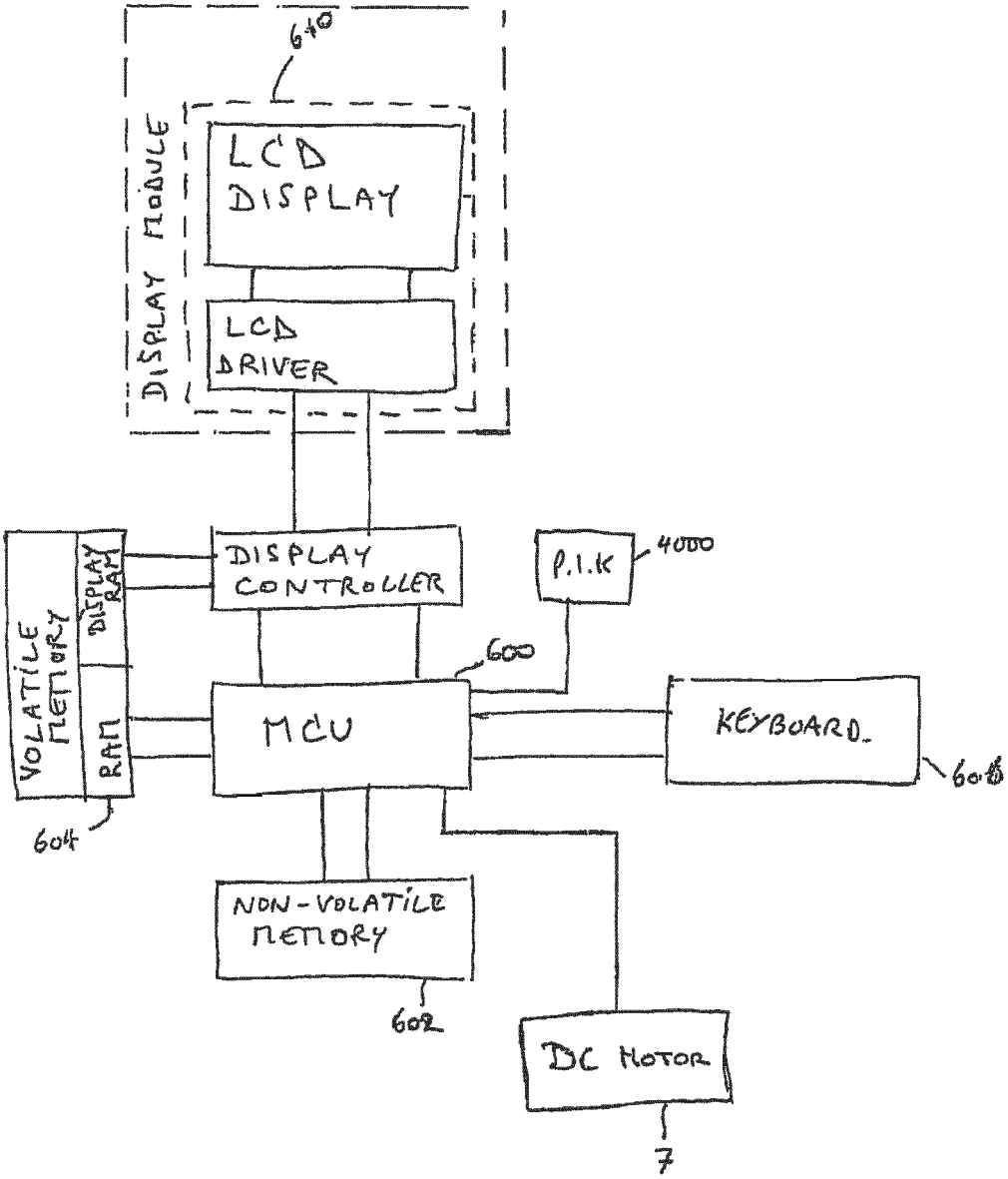
FIG. 2 is a schematic view of basic circuitry of a label printer.

Basic circuitry for controlling the label printer 1 of FIG. 1 is shown in FIG. 2. There is a controller or "control means" (such as a micro controller unit (MCU) or processor) 600, a non-volatile memory 602 which is for example a read only memory (ROM) or a flash type of memory. The flash type of memory may be used in place of, or in addition to the read only memory. A volatile memory comprising a random access memory RAM 604 and/or display RAM is also provided. The MCU 600 is connected to receive label data input to it from a data input device such as a hardware keyboard 608 including any one or more of plural keys, a mouse, a digital pen or tracker ball, or any other means for enabling a user to send commands to the controller 600. The MCU 600 outputs data to drive the display 610 to display a label to be printed (or a part thereof) and/or a message for the user. Additionally, the MCU 600 also outputs data to drive the print head 18 so that the label data is printed onto the image receiving tape to form a label. Finally, the MCU 600 also controls the motor 7 for driving the platen.

It should also be understood that where the label printer is connected to an external apparatus such as a PC, then the PC also contains similar components such as at least one memory and at least one processor to enable the PC to carry out the operations of creating a label to be printed. Such a PC will also be connected to a display means such as a monitor.

Figure 3:
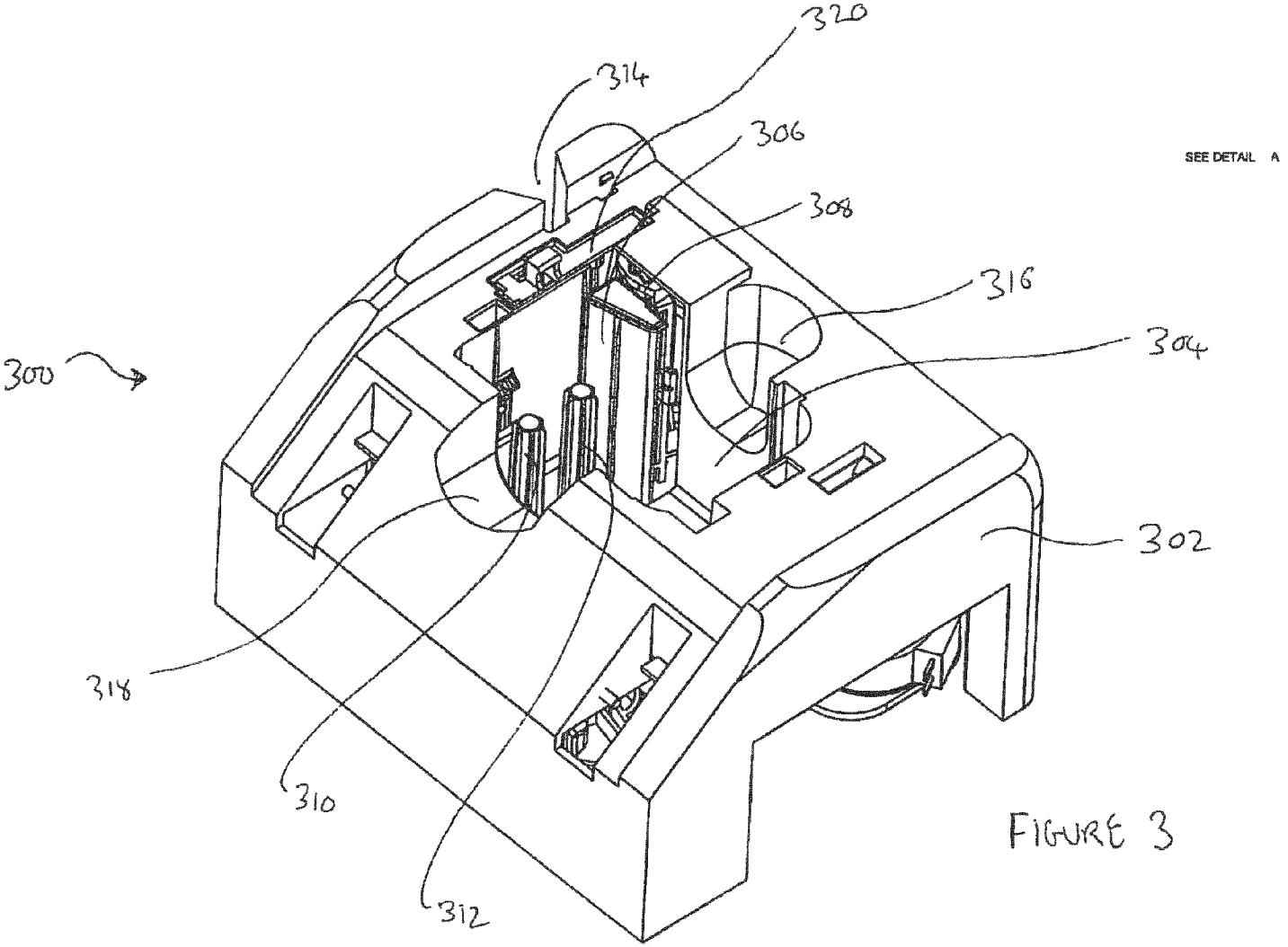
FIG. 3 is an isometric view showing certain parts of a label printer.

FIG. 3 is an isometric view of part of a label printing apparatus according to one embodiment. It should be appreciated that the features of the label printer shown schematically in FIGS. 1 and 2 may be combined with the features of the label printer of FIG. 3 in any way. The label printer 300 comprises a housing 302. The housing 302 comprises a cassette receiving bay 304 for receiving a cassette of image receiving tape. Such a cassette may also comprise a supply of ink ribbon, as discussed above. The cassette receiving bay comprises a printhead holder 306 and a platen 308, which together form a print zone for printing onto image receiving tape. The cassette receiving bay 304 also comprises drive spools 310 and 312 extending from a floor of the cassette receiving bay. The drive spools 310 and 312 are used for driving the image receiving tape through the cassette and/or for driving an ink ribbon take up spool. After the image receiving tape has passed through the print zone during a printing operation it may exit the printing apparatus 300 via outlet 314. The label printer housing 302 also comprises indented regions 316 and 318 which enable a user to easily grip a cassette with their fingers such that it can be inserted and/or removed from the label printer 301. Also visible in FIG. 3 is removable blade holder 320. This blade holder comprises a blade arrangement which enables cutting of the image receiving tape following a printing operation, such that a label can be removed from the label printing apparatus 300. The blade holder 320 is discussed in more detail below.

Figure 4:
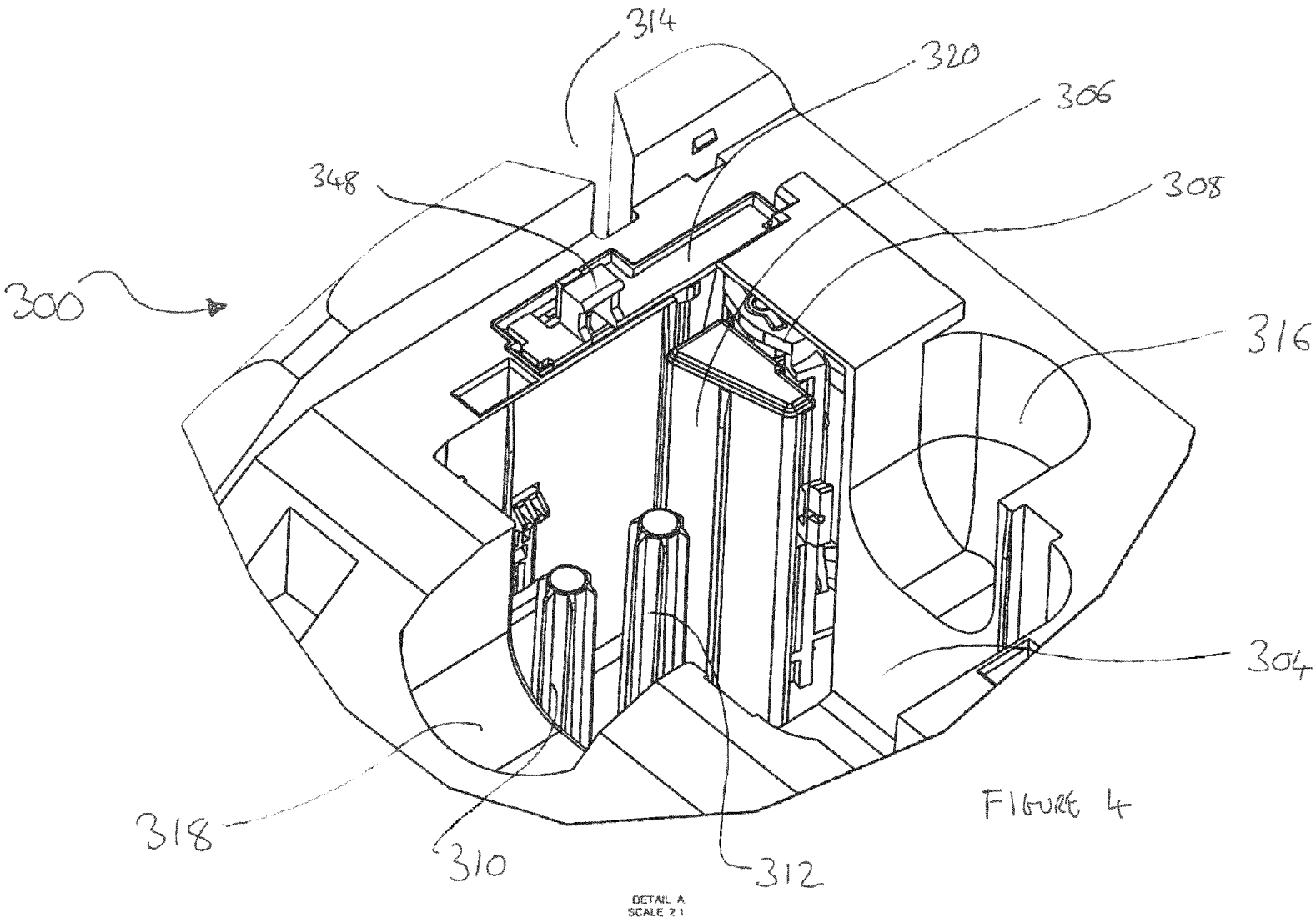
FIG. 4 is an enlarged version of a portion of FIG. 3.

FIG. 4 is an enlarged view of detail A of FIG. 3. In this Figure the numbered components can be seen more clearly.

Figure 5:
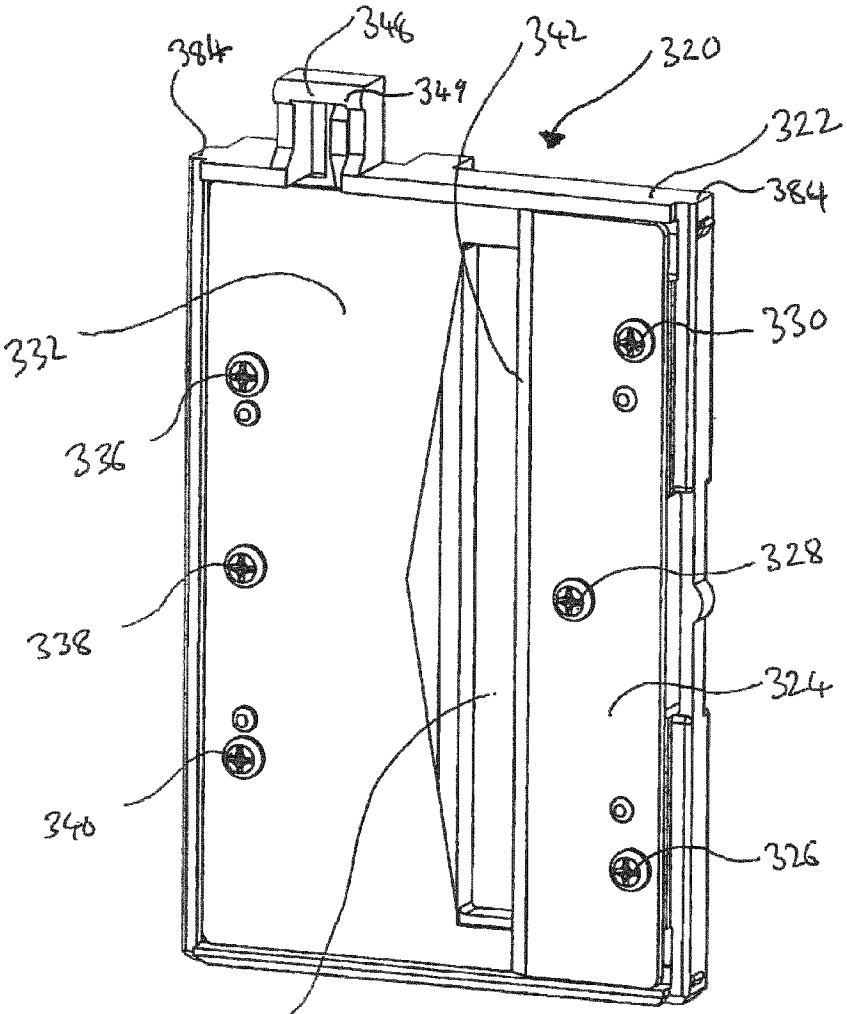
FIG. 5 shows a blade holder.

The blade holder 320 is shown in more detail in FIG. 5. The blade holder 320 comprises a casing 322 to which a fixed blade 324 is attached with screws 326, 328 and 330. The blade holder 320 also comprises a movable blade 332. The movable blade is attached to a carriage with screws 336, 338 and 340. The carriage can slide within module 320 towards and away from fixed blade 324.

Figure 6:
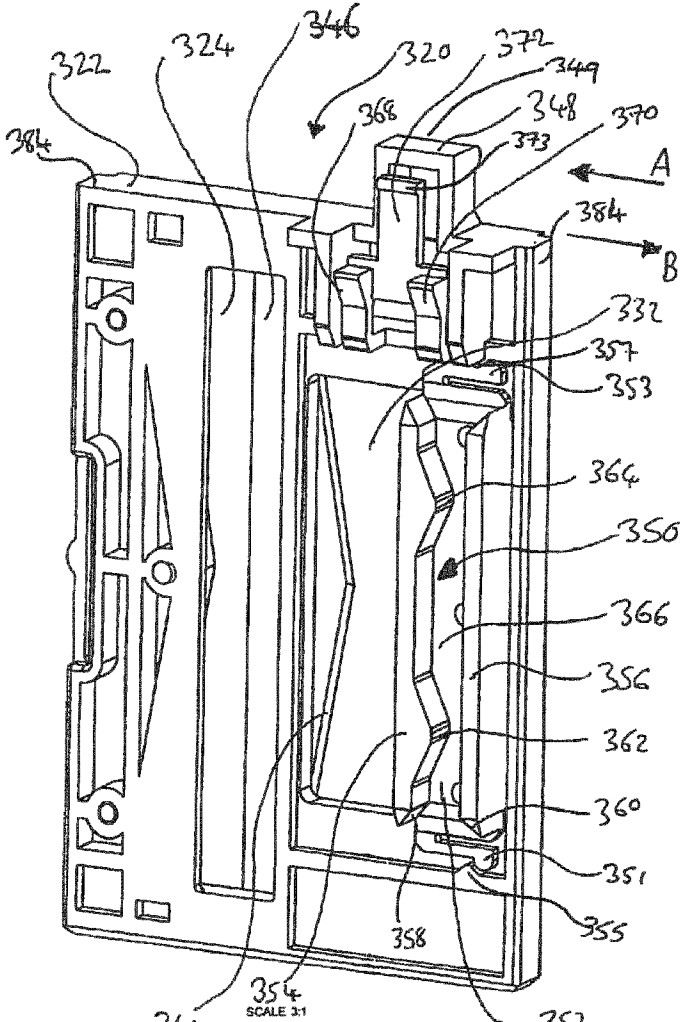
FIG. 6 is a reverse view of the blade holder of FIG. 5.

The fixed blade 324 comprises a knife portion 342 and movable blade 332 comprises knife portion 344 (best seen in FIG. 6). As the knife portion 344 of the movable blade is moved over knife portion 342 of fixed blade 324, any image receiving medium located therebetween is cut. The blade holder 320 also comprises an aperture 346 which is configured to align with outlet 314 of the label printing apparatus, when the blade holder 320 is inserted in the label printing apparatus 300. Thus any cut image receiving tape can be removed from the label printing apparatus 300 via aperture 346 and outlet 314.

The blade holder 320 also comprises a projection 348. The projection 348 enables a user to hold the blade holder 320 so that it can be easily pulled out of the label printer 300. In particular the rib portion 349 makes it easy for a user to grip and pull the blade holder 320 out of the label printer 300.

FIG. 6 shows the reverse side of the blade holder 320. Visible in this Figure is engaging portion 350 which is fixed to a rear face of movable blade 332. Accordingly movement of the engaging portion 350 results in a corresponding movement of movable blade 332. The engaging portion 350 is configured to receive a drive member of the cutter module so as to drive the engaging portion 350 and consequently the movable blade 332 towards the fixed blade 324 during a cutting operation.

In the embodiment of FIG. 6 the engaging portion 350 comprises a channel 352 located between a first wall 354 and a second wall 356. An entrance to the channel 352 comprises a chamfer 358 on first wall 354, and a chamfer 360 on second wall 356. These chamfered portions facilitate receipt of a drive member of the label printing apparatus upon insertion of the blade holder 320 into the label printing apparatus 301. This is explained in more detail below. The first wall 354 also comprises raised portions 362 and 364, between which is a trough portion 366. The trough portion 366 provides a region for locating the drive member of the label printing apparatus. Under the action of the driver member the engaging portion 350 and consequently the movable blade 332 are movable in the blade holder casing in the direction of arrow A to bring the movable blade 332 towards the fixed blade 324, and the movable blade 332 may also move in the opposite direction (in the direction of arrow B) away from the fixed blade 324.

The blade holder casing 322 also comprises ramped projections 368 and 370 which are configured to snap fit into corresponding slot 402 (see FIG. 7) in label printer 301, so that the blade holder 320 is securely held in the label printing apparatus 301. The blade holder 320 also comprises a release button 372 which can be pressed by a user to release the ramped projections 368 and 370 from the slot 402 in the label printer 301. A rib 373 on the button 372 makes it easy for a user to press button 372. The blade holder can then be slid out of the label printing apparatus 301. The combination of the ribs 373 and 349 facilitate gripping of the blade holder so that it can be easily pulled by a user.

It should be appreciated that the snap-fitting mechanism is positioned proximate to the projection 348. As shown in FIG. 4, the projection 348 projects outwardly of cassette receiving bay 304 when the blade holder 320 is installed. Accordingly a user can easily access the snap-fitting mechanism to facilitate unlocking of the blade holder 320 from the printing apparatus 300.

Preferably the projection 348 is positioned above, or approximately above, channel 352 so that minimal forces are required to pull the blade holder 320 out of the label printer 300.

FIG. 6 also shows a locking mechanism for locking the movable blade 332 and the engaging portion 350 before insertion into the label printing apparatus 300. The locking mechanism comprises resilient arms 351 and 353 which respectively engage with ramps 355 and 357 to hold the engaging portion 350 and movable blade 332 in place. This ensures that the engaging portion is correctly aligned with the drive members of the label printing apparatus as the blade holder is inserted into the label printing apparatus. The force of the drive members (as discussed below) is sufficient to overcome the engaging force of the resilient arms 351 and 353 with the ramps 355 and 357, so that during a cutting operation the resilient arms 351 and 353 are lifted over their respective ramp such that a cutting operation can take place.

Figure 7:
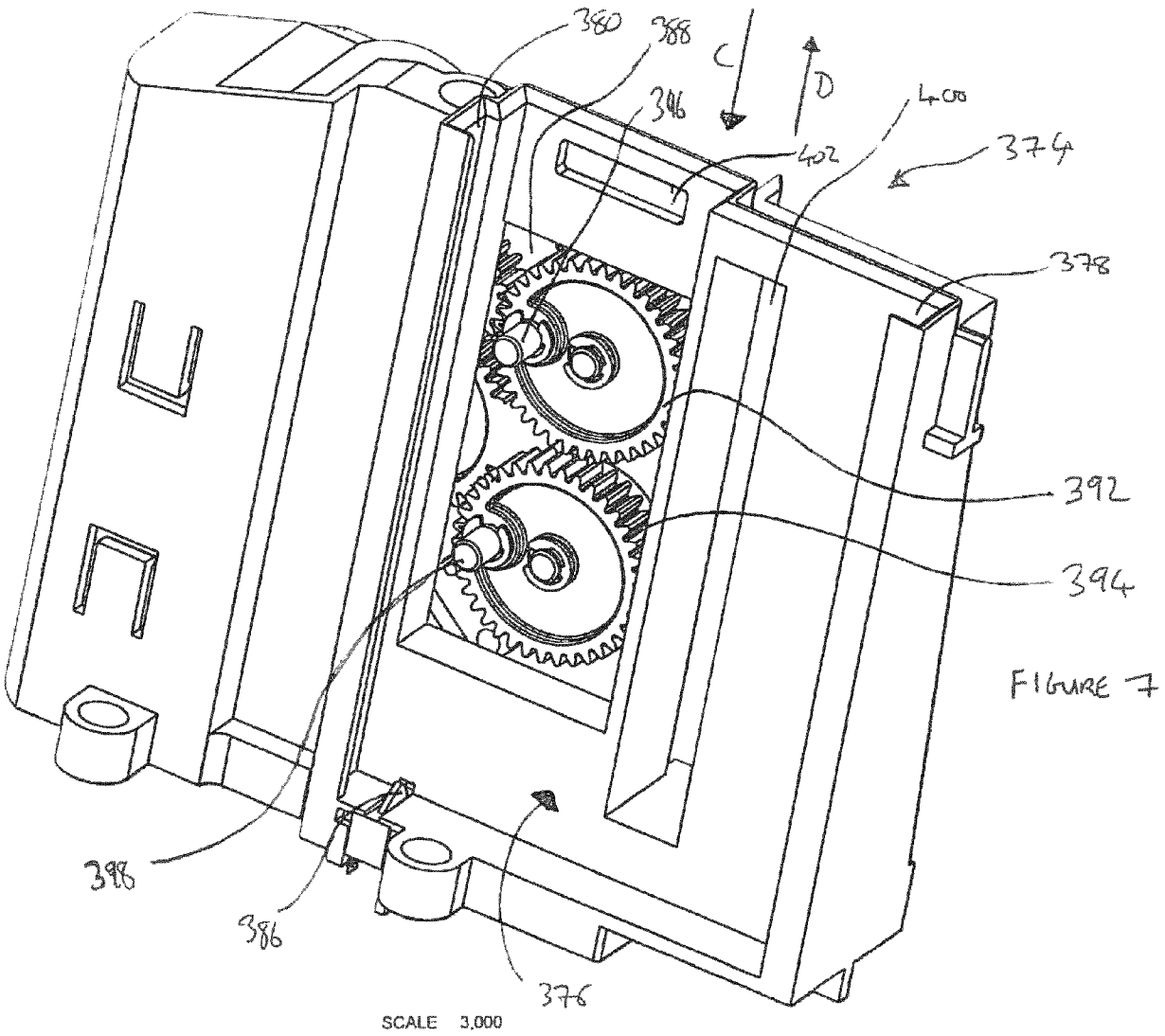
FIG. 7 is a view of a portion of a cutter module for receiving the blade holder.

FIG. 7 shows a portion 374 of the cutter mechanism for receiving the blade holder 320. The portion 374 comprises a receiving area 376 for receiving the blade holder 320. The receiving area 376 has channel portion 378 and 380 for holding ends 382 and 384 respectively of blade holder 320 (see FIGS. 5 and 6). The blade holder 320 is inserted into the portion 374 in the direction of arrow C, and is removed in the direction of arrow D.

The receiving portion 376 also comprises a detection switch 386 which is connected to the circuitry of the label printer 300. The detection switch 386 is used so that the label printer circuitry can detect whether or not the blade holder 320 is present in the label printing apparatus.

Figure 8:
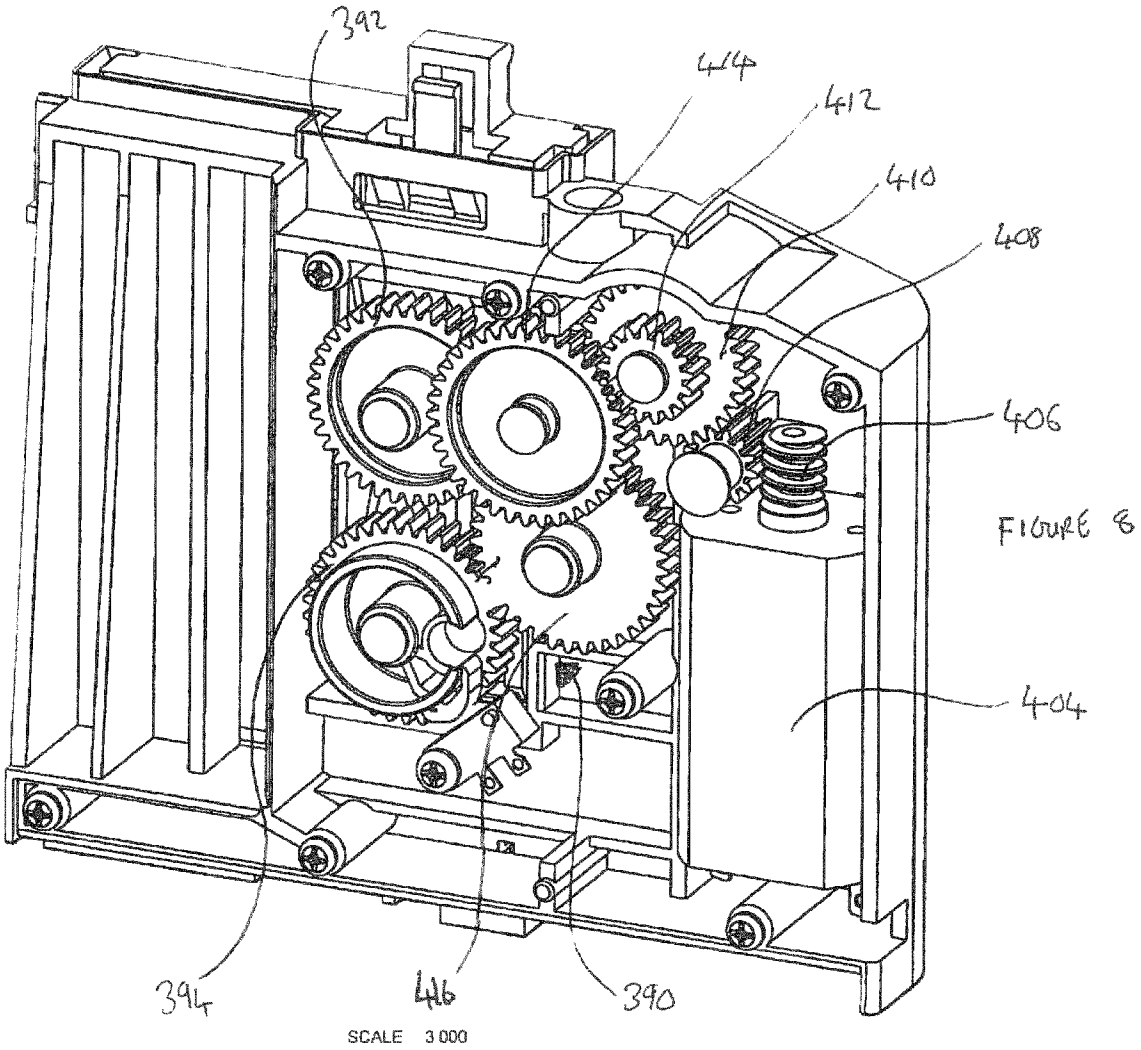
FIG. 8 shows a gear train of a motorised cutter including the blade module.

The portion 374 also comprises an aperture 388, through which gears 392 and 394 of gear train 390 are visible (see also FIG. 8). Gear 392 comprises a drive member 396 and gear 394 comprises a driver member 398. The drive members 396 and 398 are configured to engage with the engaging portion 350 of the blade holder 320. That is as the blade holder is inserted into the label printing apparatus 300 the drive members 396 and 398 enter channel 352 of the engaging portion 350. When the blade holder 320 is fully inserted in the label printer 300 then the drive members 396 and 398 are located in trough portion 366 of engaging portion 350.

It can be appreciated from viewing FIG. 7 in combination with FIG. 6 how the cutting mechanism works. As the gears 392 and 394 are rotated from their position shown in FIG. 7, then the drive members 396 and 398 press against wall 354 of engaging portion 350. This causes the engaging portion 350 and the movable blade 332 to move in the direction of arrow A when viewing FIG. 6. Following a cutting operation the gears 392 and 394 can either continue to rotate back to their position shown in FIG. 7, or can be reversed to reassume the position of FIG. 7. This reverse or return movement causes the drive members 396 and 398 to act upon second wall 356 of engaging portion 350 so as to move the engaging portion 350 and the movable blade 332 in the direction of arrow B when viewing FIG. 6 (i.e. in the direction away from the fixed blade 324).

The label printer 300 may be configured to return the gears 392 and 394, and consequently the drive members 396 and 398 to the position shown in FIG. 7 at the end of each cutting operation. This separates the fixed blade 324 from the movable blade 332. This also ensures that the drive members 396 and 398 are in the correct position to receive engaging portion 350, if the blade holder 320 is to be inserted.

Since the drive members 396 and 398 slot into the engagement portion 350 of the blade holder 320 as it is inserted, it can be appreciated that the operation of inserting and removing the blade holder 320 is relatively simple and does not require any specialist knowledge or tools on the part of the user to connect the blade holder 320 to the drive mechanism of the cutter module.

Portion 374 of label printer 300 also comprises aperture 400. The aperture 400 is configured to align with the aperture 446 of the blade holder 320, and the outlet 314 of the label printing apparatus 301.

Also visible in FIG. 7 is slot 402. The slot 402 is configured to receive ramped projections 368 and 370 of blade holder 320, such that the blade holder 320 can snap fit into the label printer 300 when it is inserted.

The gear train 390 is shown in more detail in FIG. 8. The gear train 390 is driven by DC motor 404. The DC motor 404 drives worm gear 406 which in turn drives gear 408. Drive is then transferred via gears 410, 412, 414 and 416 to gears 392 and 394. Ultimately this drives drive members 396 and 398 so as to transfer movement to movable blade 332, as discussed above.

Figure 9:
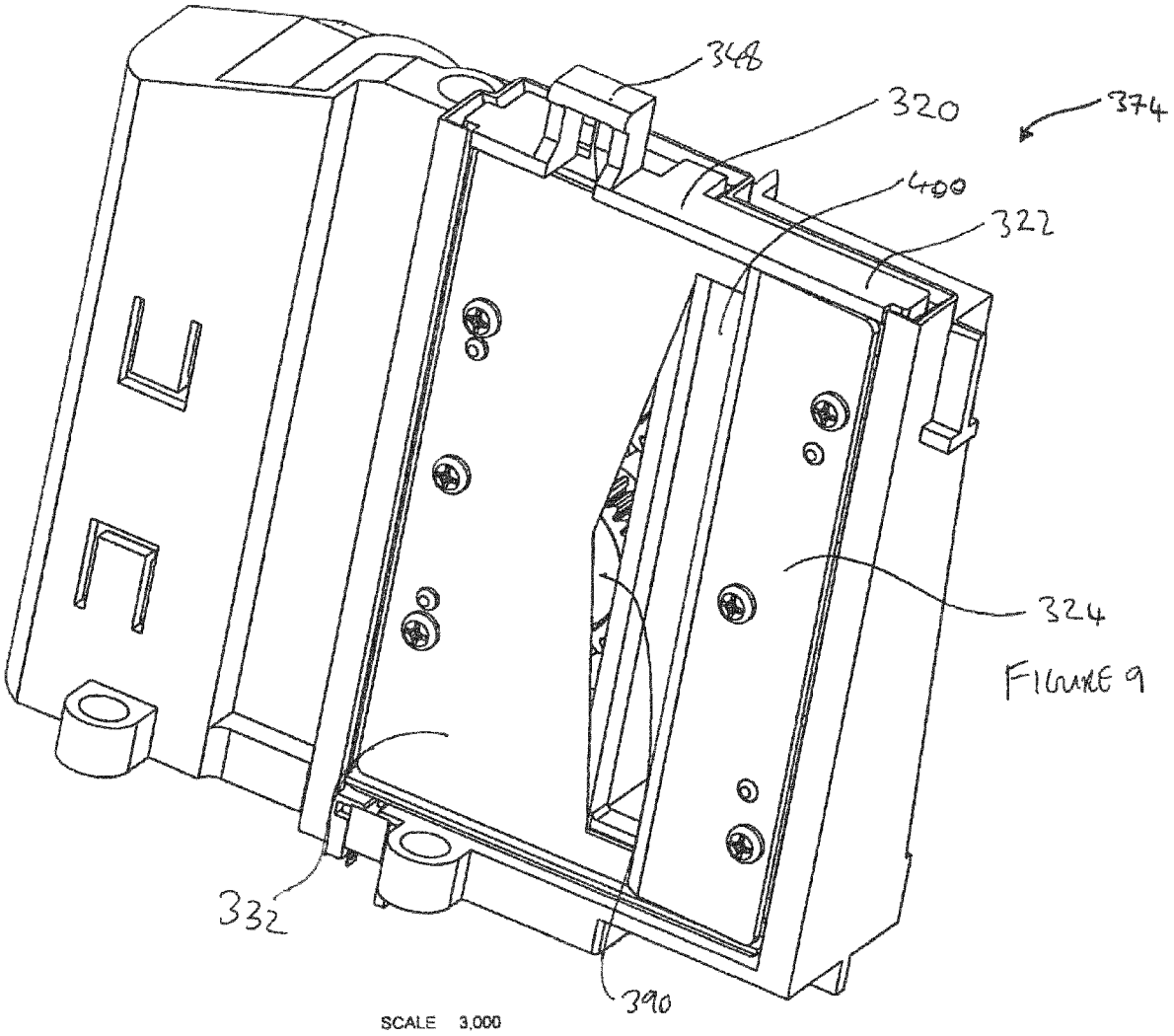
FIG. 9 shows the blade module in the motorised cutter from a reverse angle to FIG. 8.

FIG. 9 shows the portion 374 of the label printer 300 (see FIG. 7), but with the blade holder 320 inserted. FIG. 9 clearly shows the fixed blade 324, and movable blade 332. The gear train 390 is partially visible behind the movable blade 332. The aperture 400 for receiving the image receiving tape is also clearly visible. The projection 348 for facilitating removal of the blade holder 320 from the label printer 300 is also shown.

It can be appreciated that embodiments provide a blade holder that can be easily removed and replaced in a label printing apparatus. A user may wish to remove the blade holder so as to perform maintenance and/or cleaning on the blades. Such cleaning may be required as a result of build-up of adhesive from image receiving tape. As discussed above the blade holder can also be easily removed and replaced from the drive mechanism of the label printing apparatus without any specialist knowledge or tools. Some embodiments of the present invention therefore enhance the user friendliness of the label printer.

The invention claimed is:

1. A printing device comprising:

a housing;

a printing mechanism;

a receiving portion for receiving a supply of image receiving medium;

a cutting mechanism for cutting the image receiving medium; and a drive mechanism for driving the cutting mechanism during a cutting operation;

wherein the cutting mechanism comprises a blade holder removably attachable in the printing device, the blade holder comprising a fixed blade and a movable blade;

and said drive mechanism comprises a drive member for engaging with an engaging portion of said blade holder;

wherein said drive member is configured to be received in said engaging portion when said blade holder is in the printing device;

and wherein said drive member and engaging portion are configured to permit said blade holder to be slidably inserted in said printing device when said blade holder is moved in a direction of insertion, and to permit said blade holder to be slidably removed from said printing device when said blade holder is moved in a direction of removal, wherein said engaging portion comprises a channel that extends in a direction parallel to a direction in which the blade holder is configured to be inserted in said printing device.

2. A printing device comprising:
a housing;
a printing mechanism;
a receiving portion for receiving a supply of image receiving medium;
a cutting mechanism for cutting the image receiving medium; and
a drive mechanism for driving the cutting mechanism during a cutting operation;
wherein the cutting mechanism comprises a blade holder removably attachable in the printing device, the blade holder comprising a fixed blade and a movable blade;
and said drive mechanism comprises a drive member for engaging with an engaging portion of said blade holder;
wherein said drive member is configured to be received in said engaging portion when said blade holder is in the printing device;
and wherein said drive member and engaging portion are configured to permit said blade holder to be slidably inserted in said printing device when said blade holder is moved in a direction of insertion, and to permit said blade holder to be slidably removed from said printing device when said blade holder is moved in a direction of removal;
wherein the drive member is configured to project into said engaging portion in a direction perpendicular to a direction in which the movable blade is configured to be driven.

3. A printing device comprising:
a housing;
a printing mechanism;
a receiving portion for receiving a supply of image receiving medium;
a cutting mechanism for cutting the image receiving medium; and
a drive mechanism for driving the cutting mechanism during a cutting operation;
wherein the cutting mechanism comprises a blade holder removably attachable in the printing device, the blade holder comprising a fixed blade and a movable blade;
and said drive mechanism comprises a drive member for engaging with an engaging portion of said blade holder;
wherein said drive member is configured to be received in said engaging portion when said blade holder is in the printing device;
and wherein said drive member and engaging portion are configured to permit said blade holder to be slidably inserted in said printing device when said blade holder is moved in a direction of insertion, and to permit said blade holder to be slidably removed from said printing device when said blade holder is moved in a direction of removal;
wherein said movable blade comprises said engaging portion.

4. A printing device as set forth in claim 3, wherein said engaging portion is located on a face of said movable blade.

5. A printing device as set forth in claim 1, wherein said engaging portion comprises a profiled surface for locating said drive member in said engaging portion.

6. A printing device comprising:
a housing;
a printing mechanism;
a receiving portion for receiving a supply of image receiving medium;
a cutting mechanism for cutting the image receiving medium; and
a drive mechanism for driving the cutting mechanism during a cutting operation;
wherein the cutting mechanism comprises a blade holder removably attachable in the printing device, the blade holder comprising a fixed blade and a movable blade;
and said drive mechanism comprises a drive member for engaging with an engaging portion of said blade holder;
wherein said drive member is configured to be received in said engaging portion when said blade holder is in the printing device;
and wherein said drive member and engaging portion are configured to permit said blade holder to be slidably inserted in said printing device when said blade holder is moved in a direction of insertion, and to permit said blade holder to be slidably removed from said printing device when said blade holder is moved in a direction of removal;
wherein said drive mechanism comprises a gear train and said drive member is located on a gear of said gear train.

7. A printing device as set forth in claim 6, comprising a second drive member located on a second gear of said gear train.

8. A printing device as set forth in claim 1, wherein said blade holder comprises a projection for facilitating removal of said blade holder from said printing device.

9. A printing device as set forth in claim 8, wherein said projection is positioned on said blade holder such that said projection projects outwardly from said receiving portion of said printing device when said blade holder is attached in said printing device.

10. A printing device as set forth in claim 8, wherein said projection is positioned substantially above said engaging portion.

11. A printing device comprising:
a housing;
a printing mechanism;
a receiving portion for receiving a supply of image receiving medium;
a cutting mechanism for cutting the image receiving medium; and
a drive mechanism for driving the cutting mechanism during a cutting operation;
wherein the cutting mechanism comprises a blade holder removably attachable in the printing device, the blade holder comprising a fixed blade and a movable blade;
and said drive mechanism comprises a drive member for engaging with an engaging portion of said blade holder;
wherein said drive member is configured to be received in said engaging portion when said blade holder is in the printing device;
and wherein said drive member and engaging portion are configured to permit said blade holder to be slidably inserted in said printing device when said blade holder is moved in a direction of insertion, and to permit said blade holder to be slidably removed from said printing device when said blade holder is moved in a direction of removal;
wherein said blade holder is a snap-fit in said printing device.

12. A printing device as set forth in claim 11, wherein said blade holder comprises a projection for facilitating removal of said blade holder from said printing device, and wherein said snap-fit is provided by a snap-fitting mechanism provided proximate to said projection of said blade holder.

13. A printing device comprising:

a housing;

a printing mechanism;

a receiving portion for receiving a supply of image receiving medium;

a cutting mechanism for cutting the image receiving medium; and a drive mechanism for driving the cutting mechanism during a cutting operation;

wherein the cutting mechanism comprises a blade holder removably attachable in the printing device, the blade holder comprising a fixed blade and a movable blade;

and said drive mechanism comprises a drive member for engaging with an engaging portion of said blade holder;

wherein said drive member is configured to be received in said engaging portion when said blade holder is in the printing device;

and wherein said drive member and engaging portion are configured to permit said blade holder to be slidably inserted in said printing device when said blade holder is moved in a direction of insertion, and to permit said blade holder to be slidably removed from said printing device when said blade holder is moved in a direction of removal;

wherein said blade holder comprises a locking mechanism for locking the movable blade.

14. A printing device comprising:

a housing;

a printing mechanism;

a receiving portion for receiving a supply of image receiving medium;

a cutting mechanism for cutting the image receiving medium; and a drive mechanism for driving the cutting mechanism during a cutting operation;

wherein the cutting mechanism comprises a blade holder removably attachable in the printing device, the blade holder comprising a fixed blade and a movable blade;

and said drive mechanism comprises a drive member for engaging with an engaging portion of said blade holder;

wherein said drive member is configured to be received in said engaging portion when said blade holder is in the printing device;

and wherein said drive member and engaging portion are configured to permit said blade holder to be slidably inserted in said printing device when said blade holder is moved in a direction of insertion, and to permit said blade holder to be slidably removed from said printing device when said blade holder is moved in a direction of removal;

and further comprising a detector for detecting the presence of the blade holder in the printing device.

15. A blade holder for a printing device comprising:

a casing;

a fixed blade and a movable blade; and an engaging portion for engaging with a respective drive member of the printing device when received therein;

wherein said engaging portion is configured to receive said drive member when said blade holder is in the printing device;

and said engaging portion is configured to permit said blade holder to be inserted in said printing device when said blade holder is moved in a direction of insertion, and to permit said blade holder to be removed from said printing device when said blade holder is moved in a direction of removal;

and wherein said movable blade comprises said engaging portion and said engaging portion is located on a face of said movable blade.

* * * * *